US005197611A

United States Patent [19]

Walton

[11] Patent Number: 5,197,611

[45] Date of Patent: Mar. 30, 1993

[54] TISSUE PAPER ROLL STORAGE AND GRAVITY FEED

[76] Inventor: Donald L. Walton, 8502 Woodside Ct., Lanham, Md. 20706

[21] Appl. No.: 908,037

[22] Filed: Jul. 6, 1992

[51] Int. Cl.[5] ..... A47F 7/00

[52] U.S. Cl. ..... 211/59.2; 211/106; 312/45

[58] Field of Search ..... 211/59.2, 106, 181; 312/45, 72, 73

[56] References Cited

U.S. PATENT DOCUMENTS

| | | | |
|---|---|---|---|
| 2,125,000 | 7/1938 | Considine | 211/59.2 |
| 2,239,369 | 4/1941 | Nauert | 211/59.2 X |
| 2,312,825 | 3/1943 | Leveque | 312/45 X |
| 2,959,368 | 11/1960 | Neff | 312/45 X |
| 3,805,964 | 4/1974 | Titus | 211/59.2 |
| 3,809,448 | 5/1974 | Rakaska | 312/45 X |
| 4,058,354 | 11/1977 | Pawaska | 312/45 |
| 4,199,078 | 4/1980 | Ramirez | 211/59.2 X |
| 4,776,470 | 10/1988 | Chap | 211/59.2 |

*Primary Examiner*—Robert W. Gibson, Jr.

[57] ABSTRACT

A holder or rack for dispensing a plurality of rolls of tissue paper has a open ended tray for holding the rolls of paper at an incline in a bathroom sink cabinet and has a stop member at the open end of the tray. The tray permits a roll of paper to be removed and the remaining rolls to roll down the incline by the force of gravity to the stop member for easy access as needed.

13 Claims, 2 Drawing Sheets

TISSUE PAPER ROLL STORAGE AND GRAVITY FEED

BACKGROUND OF THE INVENTION

The present invention relates to a tissue paper roll storage container and roll dispenser. More particularly to a storage rack or holder which holds a plurality of rolls of tissue paper which are to be dispensed when needed. A new roll held in the storage rack being made available for dispensing by gravity feed.

Prior art storage devices and dispensers have been disclosed by the prior art as exemplified, for example by U.S. Pat. Nos. 3,809,448; 4,058,354 and 4,199,078. However these prior art devices have one or more disadvantages. For example the storage containers as disclosed by the prior art are designed to stack the rolls in a vertical manner so that as one roll is being withdrawn from the bottom of the stack, gravity feeds another roll into position for dispensing. Generally there prior art devices are to tall to fit within a cabinet under a washbasin in a bathroom and must be mounted on a nearby wall.

Another disadvantage when the prior art storage containers are mounted on the door or the inside wall of a cabinet under a washbasin, there is little space available on the floor of the cabinet for storage of other bathroom supplies since the containers take up and block access to such space.

The prior art further has a disadvantage that due to its visibility when mounted on a wall of a bathroom, it is desirable to make the containers attractive and to fully enclose the tissue paper rolls in the container. Enclosed containers take substantial amounts of material increasing the cost of construction.

SUMMARY OF THE INVENTION

The present invention provides a storage rack or holder which is particularly suited for mounting in a cabinet under a washbasin or sink. The storage rack or holder is intended for mounting on the upper inside cabinet wall generally located beside the washbasin bowl. Normally this area within the cabinet is unused space. By locating the rack in such area, it remains out of sight and out of the way of normal storage of other supplies on the floor or shelves of the cabinet.

The storage rack of the present invention is not normally in sight within the bathroom and may be constructed of less expensive or less attractive materials than is generally used by the prior art.

For the present storage rack to feed the rolls of tissue paper it is mounted on an incline. The rolls positioned in the rack will roll by the force of gravity toward the lower end of the rack as the lowermost roll is removed.

Accordingly, it is the primary object of this invention to provide a storage holder or rack for rolls of tissue paper which utilizes space which is generally not used in a cabinet.

Another object of the present invention is to provide a storage rack which is inexpensive.

A further object of the invention is to provide a storage rack which is easily installed and functions in a practical manner to feed rolls of tissue paper to an accessible position near the door of a sink cabinet.

DESCRIPTION OF THE PREFERRED EMBODIMENT

The drawings, wherein like reference numbers indicate like parts through the several views, will be used to illustrate the preferred embodiment of the invention.

Figure 1:
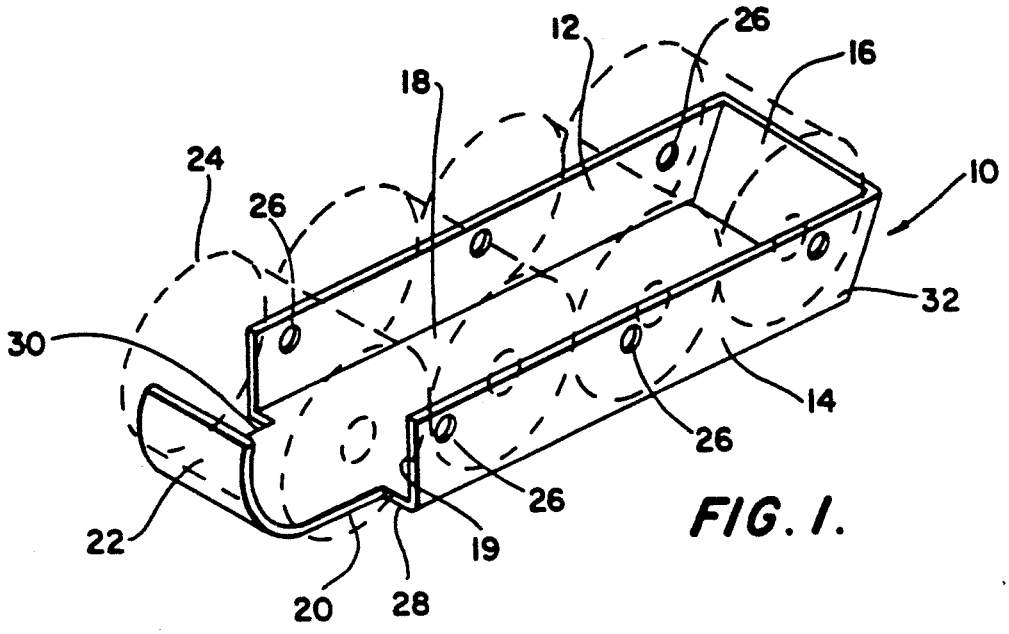
FIG. 1 is a perspective side view of the preferred embodiment of the invention made of solid sheet material.
Figure 3:
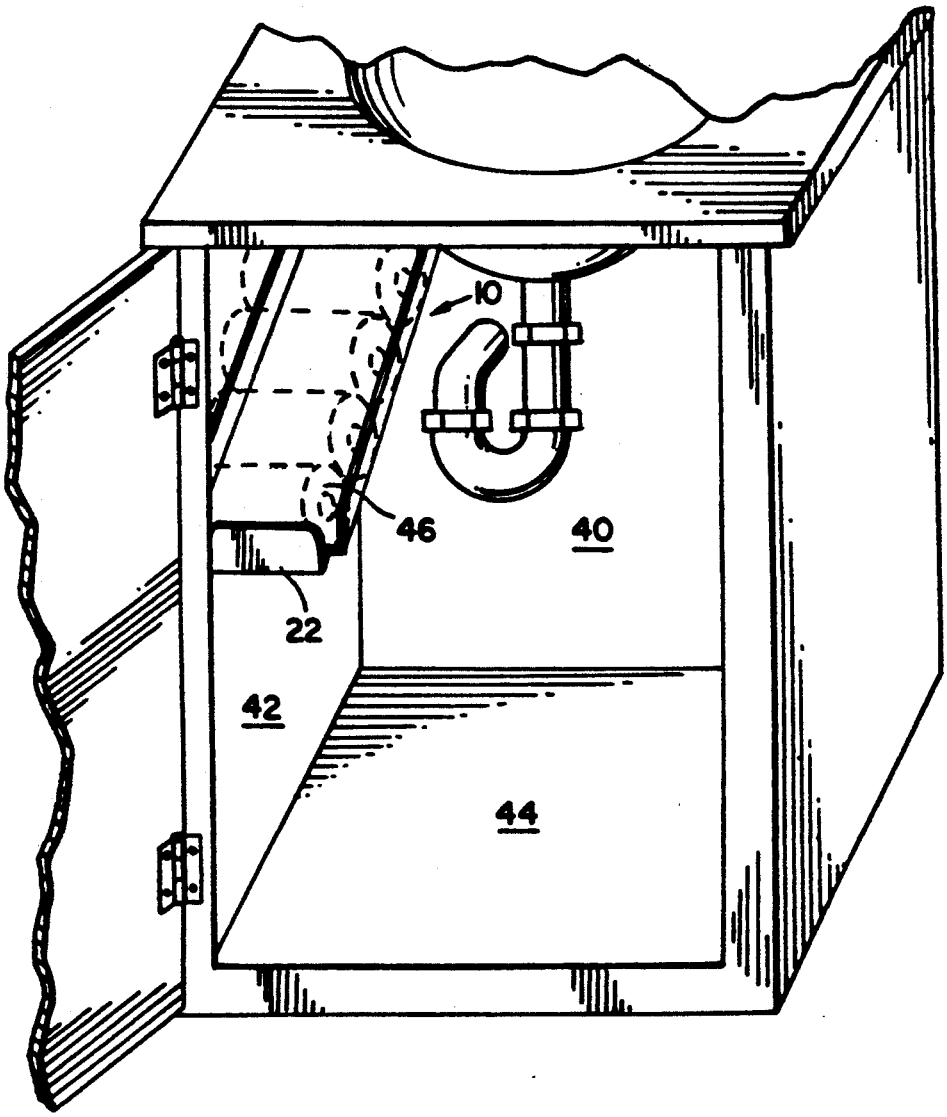
FIG. 3 is a fragmentary perspective view of a washbasin with a storage rack of the invention mounted therein.

Referring to FIG. 1 a storage rack or holder 10 representing the preferred embodiment of the invention is illustrated in a loaded condition. The rack as shown is made from a solid sheet material of plastic, wood, metal or other material sufficiently ridge to hold the tissue paper rolls. However, other materials which are not in sheet form, such as wire, could equally well be used in the construction of the rack. The rack consists of two side members 12 and 14 and an end member 16. The side and end members are attached to a bottom 18 to form a tray which is open at the other end 19. The bottom 18 is provided with an integral extension 20 at the open end 19 which extend outwardly in the plane of the bottom 18 and is attached to an upwardly extending portion to form an upwardly extending stop means 22. The stop means may be an integral member extending from extension 20 in a rounded design or may be a flat element attached to the extension as illustrated in FIG. 3. The rolls of tissue paper 24 shown in phantom may be positioned inside of the side and end members of the rack and held in position by the stop member 22. On the side members 12 and 14, openings 26 are provided to permit the storage rack 10 to be mounted with screws in the desired position in a cabinet. Other means for mounting such as a double coated adhesive tape, may equally well be provided to attach the holder or rack to a cabinet wall. The bottom extension 20 is reduced in width compared with the bottom 18 as illustrated at 28 and 30. The reduced width of the extension 20 and stop 22 permits the first roll of tissue paper being held in position by the stop member 22 to be easily grasped for removal. The end member 16 which is attached to the bottom and side members of the rack is connected to the bottom 18 at an angle 32 which is greater than 90 degrees.

Figure 2:
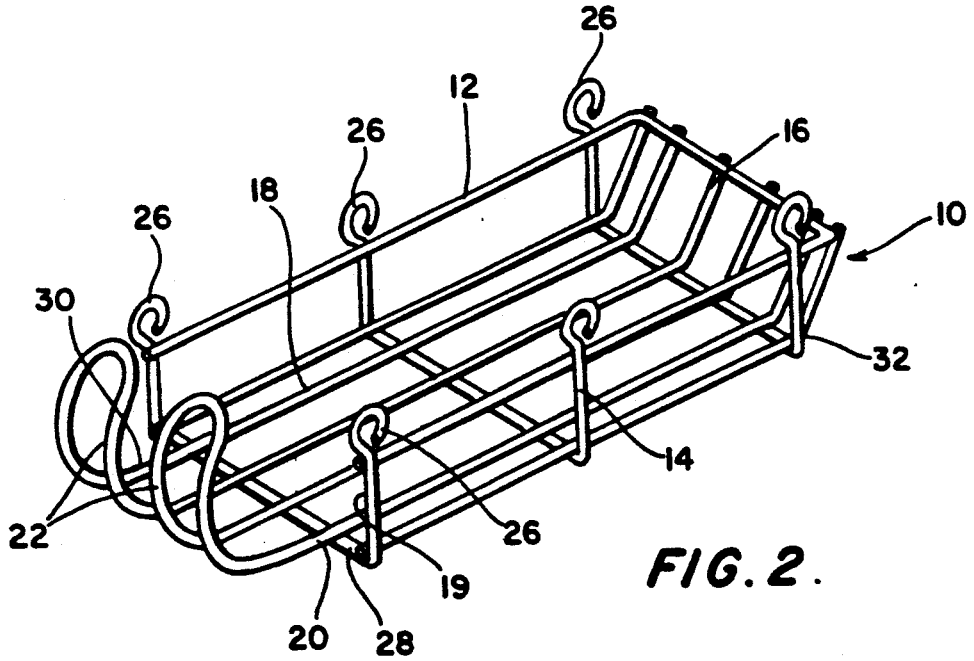
FIG. 2 is a perspective side view of another embodiment of the invention made of wire.

FIG. 2 as shown has essentially the same components as the rack or holder shown in FIG. 1. The main distinction is in the material used in its construction. A wire construction as illustrated in FIG. 2 permits the rack to be light in weight and inexpensive since less material is necessary. Openings 26 are formed in the side members 12 and 14 and when the holder is constructed of wire by eyelet type openings in the upwardly extending wire ends.

As can be seen in FIG. 3 the tissue paper storage rack or holder is to be mounted on an incline on an inside wall 42 of a sink cabinet 44. The end member 16 which is at an angle 32 with respect to the bottom of the rack (not shown in FIG. 3) permits the end member 16 to fit snugly against the back wall 40 of the cabinet. The bottom of the cabinet 44 remains free so it is available for use to store other bathroom supplies. Stop member 22 readily hold the rolls of tissue paper within the inclined rack until the first roll 46 is removed. When the first roll 46 is removed from the rack or holder the other rolls of tissue paper positioned higher in the inclined rack will roll downwardly by the force of gravity until the stop 22 is engaged by the next remaining roll.

For the storage rack or holder to fit within the side of a standard cabinet the overall length of the rack should be no longer than 18 inches. The height of the side and end members is not critical. The sides function as guides when the paper rolls roll down into position. The sides further provide means to support the storage rack in its desired position. The angle of mounting the rack must be sufficient so the paper rolls will roll down the incline when the first roll is removed but not so steep that the rolls will not stop upon contact with the stop member. The width of the inside of the rack should be about 5 inches to accommodate a standard sized roll of tissue paper.

It will be apparent to those skilled in the art that specific construction materials selected as well as various structural designs could be made without departing from the scope of this invention.

What is claimed is:

1. A holder and dispenser for a plurality of rolls of tissue paper, said holder comprising side members, an end member, a bottom, and stop means for holding the rolls in position, said side members and said end member being attached to said bottom to form an open ended tray with two sides and an end, said bottom having an extension at the open end of said tray extending outwardly and connected to said stop means, said stop means being spaced from the open ended tray and extends upwardly to a sufficient height for stopping and holding rolls of tissue paper in position in said tray, said sides being provided with means for mounting said rack to a wall, said means for mounting is provided by openings in the side members through which screws may be fitted.

2. A holder and dispenser according to claim 1 wherein said end member is attached to said bottom at an angle greater than 90 degrees and said stop means is an integrally extending member of the bottom extension.

3. A holder and dispenser according to claim 2 wherein said stop member has a rounded upward surface for contact with a tissue paper roll.

4. A holder and dispenser according to claim 1 wherein said holder is constructed of wood.

5. A holder and dispenser according to claim 1 wherein said holder is constructed of wire.

6. A holder and dispenser according to claim 1 wherein said holder is constructed of plastic.

7. A holder and dispenser according to claim 1 wherein said holder is constructed of sheet metal.

8. A cabinet for a bathroom sink, said cabinet comprising a bottom and at least two side walls, a holder and dispenser for a plurality of rolls of tissue paper mounted on the inside of one of said side walls, said holder comprising side members, an end member, a bottom, and stop means for holding the rolls in position, said side members and said end member being attached to said bottom to form an open ended tray with two sides and an end, said bottom having an extension at the open end of said tray extending outwardly and connected to said stop means, said stop means being spaced from the open ended tray and extends upwardly to a sufficient height for stopping and holding rolls of tissue paper in position in said tray.

9. A cabinet according to claim 8 wherein said holder is mounted on said wall on an incline whereby rolls of tissue paper when placed upon the holder will move downwardly by the force of gravity until said stop means is engaged.

10. A holder and dispenser for a plurality of rolls of tissue paper, said holder comprising side members, an end member, a bottom, and stop means for holding the rolls in position, said side members and said end member being attached to said bottom to form an open ended tray with two sides and an end, said bottom having an extension at the open end of said tray extending outwardly and connected to said stop means, said stop means being spaced from the open ended tray and extends upwardly to a sufficient height for stopping and holding rolls of tissue paper in position in said tray, said sides being provided with means for mounting said rack to a wall, said means for mounting in a double coated adhesive tape attached along one of said side members.

11. A holder and dispenser according to claim 10 wherein said holder is constructed of wood.

12. A holder and dispenser according to claim 10 wherein said holder is constructed of plastic.

13. A holder and dispenser according to claim 10 wherein said holder is constructed of sheet metal.

* * * * *